United States Patent [19]

Mattei

[11] Patent Number: 4,617,943

[45] Date of Patent: Oct. 21, 1986

[54] CIGARETTE MANUFACTURING MACHINE

[75] Inventor: Riccardo Mattei, Bologna, Italy

[73] Assignee: G.D Societa' per Azioni, Bologna, Italy

[21] Appl. No.: 730,990

[22] Filed: May 6, 1985

[30] Foreign Application Priority Data

May 18, 1984 [IT] Italy ..... 3469 A/84

[51] Int. Cl.[4] ..... A24C 5/02

[52] U.S. Cl. ..... 131/109.3; 131/109.1

[58] Field of Search ..... 131/84.1, 84.2, 84.3, 131/84.4, 108, 109.1, 109.2, 109.3, 110

[56] References Cited

U.S. PATENT DOCUMENTS 1,817,319 8/1931 Muller ..... 131/109.1

FOREIGN PATENT DOCUMENTS 826914 1/1938 France ..... 131/109.1

*Primary Examiner*—V. Millin

*Attorney, Agent, or Firm*—Marshall, O'Toole Gerstein, Murray & Bicknell

[57] ABSTRACT

Cigarette manufacturing machine comprising a distributor on which a duct for conveying shredded tobacco presents an intermediate portion tapered towards the outlet on the duct itself, the intermediate portion being defined by walls at least one of which oscillates crosswise in relation to the travelling direction of the tobacco in the duct.

8 Claims, 4 Drawing Figures

30
32
43
31
52
44
54
55
49
50
51
45
47
46
34
53
48
35
33
36

1
2
3
4
5
6
7
8
9
10
11
12
13
14
15
16
17
18
19
20
21
22
23
24
25
26
27
28
29
30
31
32
33
34
35
36
37
38
39
40
41
42
47

CIGARETTE MANUFACTURING MACHINE

BACKGROUND OF THE INVENTION

The present invention relates to a cigarette manufacturing machine.

Cigarette manufacturing machines are known to employ a distributor for receiving shredded tobacco from a feeder and supplying it, via a carding unit and drop-down duct, towards a withdrawal unit which extracts the shredded tobacco from the bottom end of the said drop-down duct and feeds it, in the form of a relatively thin layer, on to a conveyor belt. By means of the latter, the said layer of tobacco is fed into the bottom end of an upward duct into which the tobacco particles are usually sucked up and deposited on to one or more suction belts on a unit for producing a continuous cigarette rod.

The main requisite of a cigarette manufacturing machine is to ensure the continuous cigarette rod is as homogeneous as possible. Generally speaking, the homogeneous nature of the said cigarette rod depends on how homogeneously the tobacco layer is formed on the said conveyor belt which, in turn, depends on the regularity with which the said withdrawal unit extracts the tobacco from the bottom end of the drop-down duct and on the manner in which the tobacco is fed down the latter.

On known cigarette manufacturing machines, the said drop-down duct is usually of constant section, essentially rectangular, with its longer side extending crosswise in relation to the travelling direction of the said conveyor belt.

Experiments have shown that a constant duct section prevents the mass of tobacco fed into the said duct from being blended or its density from being varied as it falls down the duct. Consequently, the unhomogeneous nature of the original mass of tobacco invariably influences the quality of the tobacco layer formed on the said conveyor belt. Furthermore, for a given shape of the drop-down duct section, the density of the tobacco fed into the duct tends to vary, not only from one section to another, but even within each section, such variation being proportional to the ratio between the lengths of the longer and shorter sides of the said section.

SUMMARY OF THE INVENTION

The aim of the present invention is to provide a cigarette manufacturing machine having a distributor designed to produce as homogeneous a layer of tobacco as possible on the said conveyor belt.

With this aim in view, the present invention relates to a cigarette manufacturing machine comprising a shredded tobacco distributor, in turn, comprising a drop-down duct for the said tobacco, means for feeding the said tobacco into an inlet on the said duct, and means for withdrawing the said tobacco from an outlet on the said duct, characterised by the fact that the said duct presents an intermediate portion tapered towards the said outlet and comprising at least one wall oscillating crosswise in relation to the travelling direction of the said tobacco in the said duct.

Tapering the said intermediate portion on the said duct enables the tobacco travelling down the duct to be compacted slightly, thus reducing the unhomogeneous nature of the tobacco crosswise in relation to its travelling direction. Furthermore, the oscillating movement of the said wall provides for smoother feed of the tobacco through the said tapered intermediate portion, as well as for lightly compacting the tobacco downwards and in the direction of the said withdrawal unit which is thus fed at all times with essentially constant amounts of tobacco distributed essentially evenly crosswise in relation to the said travelling direction.

BRIEF DESCRIPTION OF THE DRAWINGS

A number of non-limiting arrangements of the present invention will now be described with reference to the attached drawings in which.

DETAILED DESCRIPTION OF THE INVENTION

Figure 1:
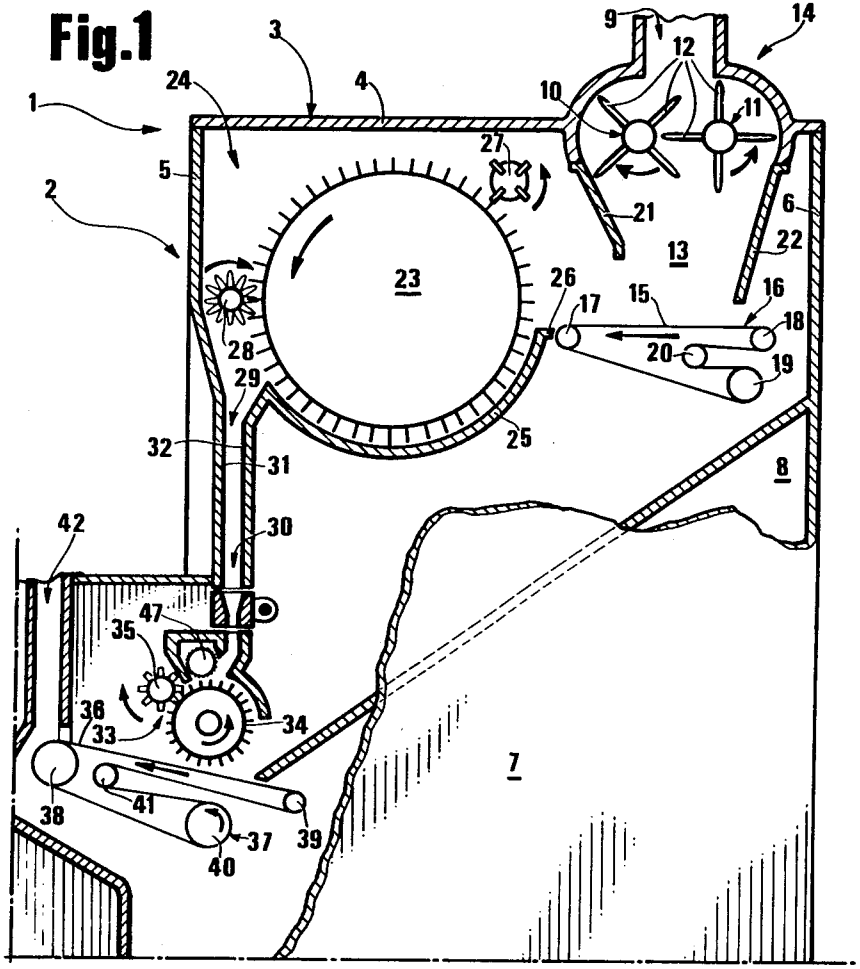
FIG. 1 shows a vertical section of part of a cigarette manufacturing machine according to the present invention.

FIG. 1 shows a cigarette manufacturing machine 1 comprising a distributor 2 for forming, from a mass of shredded tobacco, a steady, uniform stream of tobacco particles. The component parts on distributor 2 are housed in a vertical casing 3 closed at the top by horizontal wall 4 and at the sides by vertical walls 5 and 6.

On two sides parallel with the FIG. 1 plane, casing 3 is closed by a front wall 7 and a rear wall 8.

Top wall 4 presents an opening for a rectangular-section input duct 9 at the bottom of which are fitted, inside casing 3, two powered rollers 10 and 11 with radial teeth 12 all round.

Rollers 10 and 11 turn in opposite directions for pre-carding the tobacco and feeding it into a chamber 13 underneath.

Duct 9 and rollers 10 and 11 combine to form a pre-feed unit 14 over chamber 13, the bottom of the latter being defined by a conveyor belt 15 consisting of the top branch of a belt 16 looped round three guide rollers, 17, 18 and 19, at least one of which is powered, and round a tensioning roller 20.

Two sloping, converging walls 21 and 22, both extending downwards from wall 4, direct the tobacco dropping down from pre-feed unit 14 on to belt 15.

On the opposite side to wall 22, chamber 13 is flanked by a toothed carding roller 23 forming part of a carding or main feed unit 24 next to the downstream end of belt 15.

Beneath roller 23, provision is made for a cylindrical panel 25 coaxial with the said roller 23 and having, on one end, a scraper 26 extending between roller 23 and the downstream end of belt 15.

In addition to roller 23, unit 24 also comprises a so-called batching roller 27 turning the same way as and located over and essentially touching roller 23. By virtue of such an arrangement, the tobacco fed by upper pre-feed unit 14 on to belt 15 is forced by the latter through scraper 26 on to carding roller 23.

Carding roller 23 feeds out of chamber 13, and downstream from its point of tangency with batching roller 27, a layer of tobacco essentially equal in thickness to the radial dimension of its teeth.

A toothed, so-called hurling roller 28 picks the tobacco layer off roller 23 and hurls it, in the form of separate particles, into a feedbox 29 communicating with the inlet of an essentially vertical duct 30 defined by two walls 31 and 32. At the bottom end, duct 30 presents an outlet facing a withdrawal unit 33, the latter comprising a conveyor arranged facing the said outlet and consisting of a toothed roller 34 designed to draw the tobacco out of duct 30 and turning round an axis parallel with the axis of carding roller 23.

Unit 33 also comprises a toothed, so-called hurling roller 35 for picking the tobacco off the teeth on roller 34 and hurling it, in the form of separate particles, into a chamber the bottom wall of which is defined by a so-called collecting belt 36 travelling upwards from right to left as shown in FIG. 1.

Belt 36 consists of the top branch of belt 37 looped round three guide rollers, 38, 39 and 40, at least one of which is powered, and held taut by tensioning roller 41.

Roller 38 is located next to the bottom end of an upward duct 42 the top end of which (not shown) communicates with a cigarette rod forming unit (not shown).

On the said rod forming unit, the tobacco particles are known to cling to the bottom face of at least one suction conveyor belt (not shown) so as to form on the same a continuous layer of tobacco (not shown).

Figure 2:
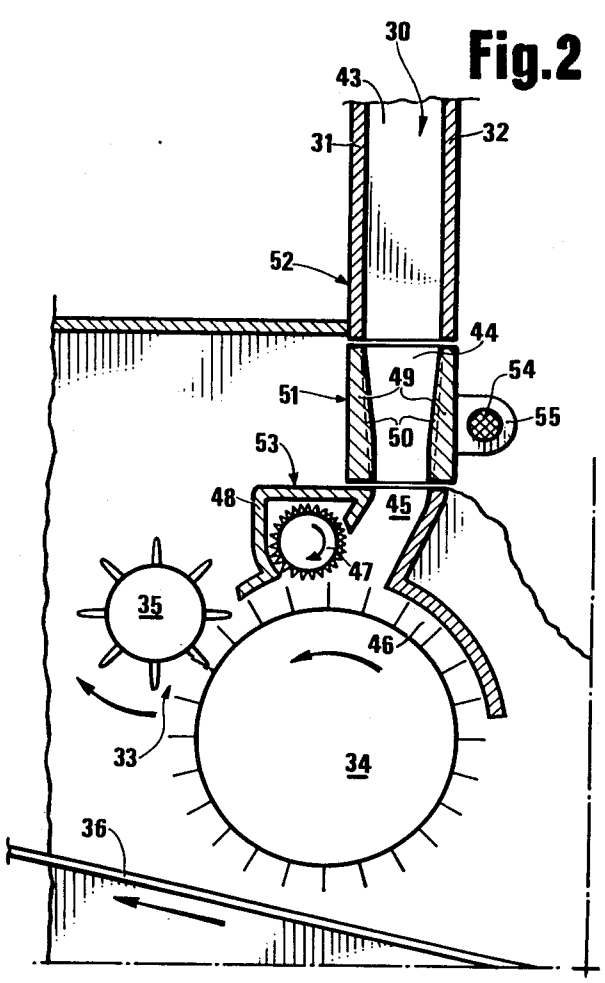
FIG. 2 shows a larger-scale view of a detail on the FIG. 1 machine.

As shown, particularly in FIG. 2, duct 30 is essentially rectangular in section and comprises a top inlet portion 43, connected to the outlet on feedbox 29, an intermediate portion 44 and an outlet portion 45 the bottom end of which communicates with a curved duct 46 extending round roller 34 and swept by the teeth extending radially outwards from the edge of the same.

Part of the surface of outlet portion 45, at the junction of ducts 30 and 46, is defined by a feed roller 47 mounted in rotary manner on a fixed support 48 downstream from duct 30 in the travelling direction of the tobacco along duct 46 and essentially tangent with roller 34. Roller 47, which cooperates with roller 34 for drawing off tobacco from the bottom end of duct 30, presents a corrugated or knurled surface and may, if so preferred, be fitted with radial needles. Both the surface configuration of roller 47 and its rotation speed in the opposite direction to roller 34, however, depend normally on the type of tobacco being used. The rotation speed of roller 34 also varies according to the type of tobacco used, though not necessarily in the same proportion as the speed of roller 47.

As shown in FIG. 2, intermediate portion 44 on duct 30 is tapered towards outlet portion 45, the section of the latter, however, increasing slightly in the direction of duct 46. In more detail, intermediate portion 44 is partly defined by two facing walls 49 lying essentially crosswise in relation to duct 46 and the inner surfaces of which converge downwards. From the sloping inner surface of each wall 49, a number of longitudinal, essentially-traingular ribs 50 extend inward of duct 30 for engaging the mass of tobacco flowing down duct 30.

In an alternative arrangement not shown, intermediate portion 44 is provided with a single sloping wall 49 having ribs 50 and facing a surface essentially parallel with the axis of duct 30.

As shown in FIG. 2, intermediate portion 44 of duct 30 is formed through a moving body 51 located between two fixed bodies, 52 and 53, through which are formed inlet and outlet portions 43 and 45 on duct 30 respectively.

In more detail, body 51 is designed to oscillate, in relation to bodies 52 and 53, crosswise in relation to the travelling direction of the tobacco down duct 30 and parallel with the rotation axis of roller 34. Body 51 is oscillated by actuating means (not shown) the output shaft 54 of which is connected integral with body 51 by means of a side appendix 55 on the latter. In addition to improving the flow to tobacco down duct 30 and compacting it sufficiently for overcoming the tapered part of intermediate portion 44, the oscillating movement of body 51 combines with ribs 50 for shifting the tobacco crosswise as it flows down duct 30 and thus providing for more even distribution of the tobacco crosswise in relation to its travelling direction.

Uniform filling of the spaces between adjacent teeth on roller 34 and the formation of a uniform layer of tobacco on belt 36 are ensured by the gradually widening section on outlet portion 45 of duct 30 in the direction of roller 34, and by roller 47 the main function of which is to eliminate friction between the tobacco and the surface of outlet portion 45 and so prevent tobacco from accumulating at the junction of ducts 30 and 46.

Figure 3:
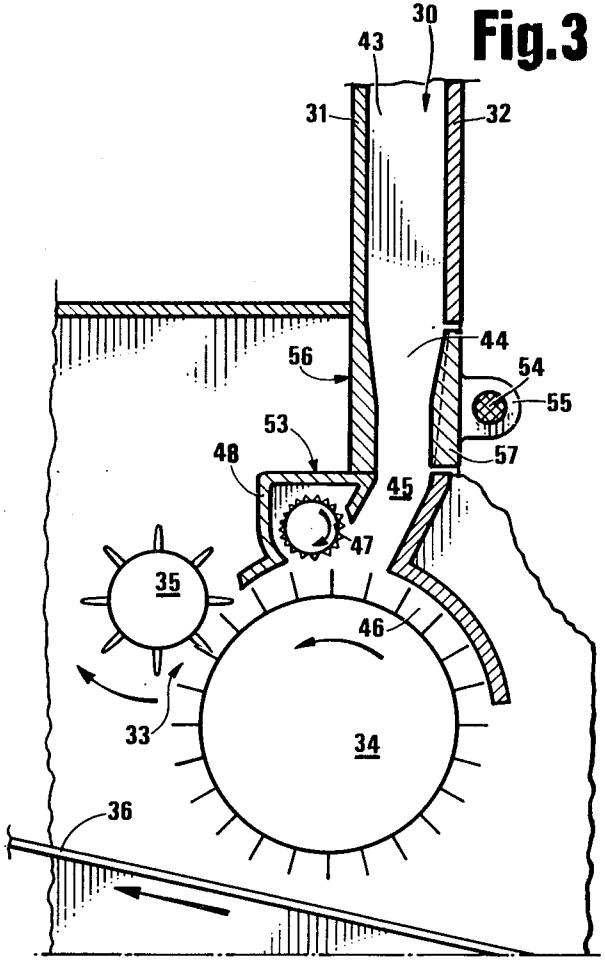

In an alternative arrangement shown in FIG. 3, bodies 51, 52 and 53 in FIG. 2 form a single integral body 56 comprising a single oscillating wall 57 arranged crosswise in relation to the axis of duct 30 and parallel with the axis of roller 34, the said wall 57 defining part of the surface of intermediate portion 44 on duct 30. Wall 57 is fitted with an integral appendix 55 and a shaft 54 for imparting the crosswise oscillating movement already described in connection with body 51 in FIG. 2.

Figure 4:
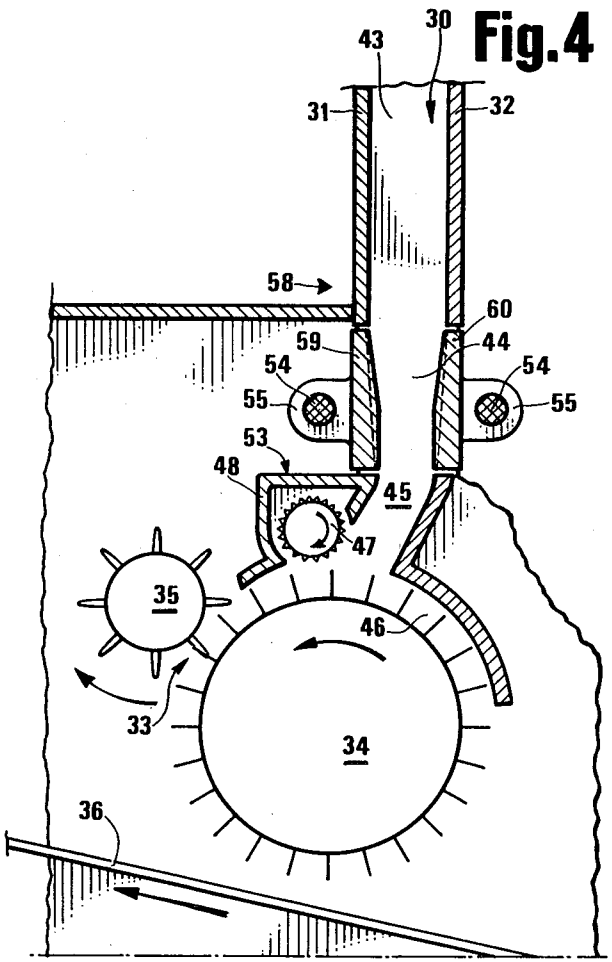
FIGS. 3 and 4 show two variations of the FIG. 2 detail.

In an alternative arrangement shown in FIG. 4, bodies 51, 52 and 53 in FIG. 2 again form a single integral body 58, but having two oscillating walls, 59 and 60, arranged crosswise in relation to the axis of duct 30 and parallel with the axis of roller 34. Walls 59 and 60 are arranged facing and define part of the surface of intermediate portion 44 on duct 30. Each of walls 59 and 60 is fitted with an integral appendix 55 and shaft 54 for imparting the crosswise oscillating movement already described in connection with body 51 in FIG. 2.

The oscillating frequency of walls 59 and 60 may, of course, be the same or different as required. In the case of the same oscillating frequency being applied on both walls, oscillation may be synchronized or offset as required.

I claim:

1. Cigarette manufacturing machine (1) comprising a shredded tobacco distributor (2), in turn, comprising a drop-down duct (30) for the said tobacco, means (23) for feeding the said tobacco into an inlet on the said duct (30), and means for withdrawing the said tobacco from an outlet on the said duct (30), characterised by the fact that the said duct (30) presents an intermediate portion (44) tapered towards the said outlet and comprising at least one flat wall (49 or 57 or 59,60) oscillating crosswise in its plane in relation to the travelling direction of the said tobacco in the said duct (30).

2. Machine according to claim 1, characterised by the fact that the said withdrawal means comprise a conveyor (34) moving essentially crosswise in relation to the said travelling and oscillating directions.

3. Machine according to claim 2, characterised by the fact that the said duct (30) comprises an outlet portion (45) tapered towards the said intermediate portion (44).

4. Machine according to claim 3, characterised by the fact that the said withdrawal means comprise a feed roller (47) cooperating with the said conveyor (34); at least part of the surface of the said outlet portion (45) located downstream in the travelling direction of the said conveyor (34) being defined by an edge surface on the said roller (47).

5. Machine according to claim 1, characterized by the fact that the said intermediate portion (44) comprises two spaced walls (49 or 59, 60) both of which oscillate crosswise in relation to said travelling direction of said tobacco.

6. Machine according to claim 5, characterised by the fact that at least one of the said two walls (49 or 59, 60) presents an inner surface at least partly sloping towards the other wall.

7. Machine according to claim 5, characterised by the fact that at least one of the said two walls (49 or 59, 60) presents an inner surface having ribs (50) extending longitudinally in relation to the said duct (30).

8. Machine according to claim 5, characterised by the fact that the said two walls (49) are integral and form part of a single oscillating body (51) defining the said intermediate portion (44) on the said duct (30).

* * * * *